US007455628B1

(12) United States Patent
Stearns et al.

(10) Patent No.: US 7,455,628 B1
(45) Date of Patent: Nov. 25, 2008

(54) ELLIPTICAL EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 11/656,874

(22) Filed: Jan. 22, 2007

Related U.S. Application Data

(60) Provisional application No. 60/760,578, filed on Jan. 21, 2006.

(51) Int. Cl.
*A63B 22/04* (2006.01)
*A63B 22/06* (2006.01)
*A63B 22/00* (2006.01)

(52) U.S. Cl. ..... 482/57; 482/52; 482/70

(58) Field of Classification Search ..... 482/52
See application file for complete search history.

(56) References Cited

U.S. PATENT DOCUMENTS

| | | | | | |
|---|---|---|---|---|---|
| 2,842,250 | A * | 7/1958 | Dowd et al. | ..... | 400/616.1 |
| 5,573,480 | A | 11/1996 | Rodgers, Jr. | ..... | 482/57 |
| 5,653,662 | A | 8/1997 | Rodgers, Jr. | ..... | 482/52 |
| 5,762,588 | A | 6/1998 | Chen | ..... | 482/57 |
| 5,766,113 | A * | 6/1998 | Rodgers, Jr. | ..... | 482/52 |
| 5,800,315 | A | 9/1998 | Yu et al. | ..... | 482/57 |
| 5,993,359 | A | 11/1999 | Eschenbach | ..... | 482/57 |
| 6,030,320 | A * | 2/2000 | Stearns et al. | ..... | 482/57 |
| 6,135,923 | A | 10/2000 | Stearns et al. | ..... | 482/51 |
| 6,196,948 | B1 | 3/2001 | Stearns et al. | ..... | 482/52 |
| 6,248,044 | B1 | 6/2001 | Stearns et al. | ..... | 482/52 |
| 6,612,969 | B2 | 9/2003 | Eschenbach | ..... | 482/51 |
| 6,629,909 | B1 | 10/2003 | Stearns et al. | ..... | 482/52 |
| 6,637,291 | B2 * | 10/2003 | Odom | ..... | 74/594.1 |
| 6,652,424 | B2 * | 11/2003 | Dalebout | ..... | 482/54 |
| 6,689,020 | B2 * | 2/2004 | Stearns et al. | ..... | 482/52 |
| 6,821,230 | B2 * | 11/2004 | Dalebout et al. | ..... | 482/51 |
| 6,835,166 | B1 | 12/2004 | Stearns et al. | ..... | 482/52 |
| 7,223,209 | B2 * | 5/2007 | Lee | ..... | 482/52 |
| RE39,904 | E * | 10/2007 | Lee | ..... | 482/52 |
| 2007/0060449 | A1 * | 3/2007 | Lo | ..... | 482/52 |
| 2007/0060450 | A1 * | 3/2007 | Lo | ..... | 482/52 |

* cited by examiner

*Primary Examiner*—Fenn C. Mathew
*Assistant Examiner*—Robert F Long

(57) ABSTRACT

An exercise apparatus links rotation of left and right cranks to elliptical movement of left and right foot supporting members. The foot supporting members include left and right foot platforms that travel through space defined between the left and right cranks. Rollers on the cranks allow the foot supporting members to translate relative to the cranks, and amplified drawbar/rocket link arrangements determine the extent of the translation.

11 Claims, 4 Drawing Sheets

100
33
42
Q
28
30
V
20
T
14
26
99
22
55
8
199

ELLIPTICAL EXERCISE METHODS AND APPARATUS

CROSS-REFERENCE TO RELATED APPLICATIONS

Disclosed herein is subject matter that is entitled to the filing date of U.S. Provisional Application No. 60/760,578, filed Jan. 21, 2006.

FIELD OF THE INVENTION

The present invention relates to exercise methods and apparatus and more particularly, to exercise equipment that guides a person's feet through generally elliptical paths of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and various other machines allow a person to skate and/or stride in place. Yet another type of exercise equipment has been designed to facilitate relatively more complicated exercise motions and/or to better simulate real life activity. Such equipment typically converts a relatively simple motion, such as circular, into a relatively more complex motion, such as elliptical. Despite various advances in elliptical motion exercise machines, room for improvement still exists.

SUMMARY OF THE INVENTION

The present invention may be described in terms of linkage assemblies and corresponding exercise apparatus which link circular motion to relatively more complex, generally elliptical motion. More specifically, left and right cranks are rotatably mounted on respective sides of a frame to provide rotating left and right connection points which define a space therebetween. Left and right foot supporting linkages are movably interconnected between the frame and respective connection points in such a manner that rotation of the cranks is linked to generally elliptical movement of adjacent left and right foot platforms. The linkages include foot supporting members that are connected, but not coupled, to respective connection points for purposes of determining vertical movement of a person's feet (as a function of the crank diameter traversed by the cranks). The linkages also include drawbar/rocker link arrangements that determine horizontal movement of the person's feet (independent of the crank diameter). These "decoupled" foot platforms or dual drive assemblies facilitate increases in stride length and/or decreases in machine length.

The foot supporting members are preferably configured and arranged to accommodate movement of a person's feet into the space defined between the cranks. This arrangement allows for shorter machines without sacrificing stride length. At least one guard or shield may be provided between the foot platforms to eliminate pinch points and/or reduce the likelihood of the user's feet or ankles striking one another during exercise.

In another respect, the present invention may be described in terms of linkage assemblies and corresponding exercise apparatus which link reciprocal motion to relatively more complex, generally elliptical motion. For example, left and right handlebar links may be pivotally mounted on the frame and linked to at least one link in the elliptical motion linkage assembly. As the foot supports move through their generally elliptical paths, the handlebras pivot back and forth relative to the frame. In order to accommodate the proximity of the foot platforms on the preferred embodiment, the frame may be provided with opposite side posts for supporting respective handlebar links at outboard locations relative to the foot supporting linkages.

In yet another respect, the present invention may be described in terms of linkage assemblies and corresponding exercise apparatus which independently generate the horizontal and vertical components of generally elliptical exercise motion. In this regard, the foot platforms are driven up and down by respective cranks (as a function of the crank diameter), and forward and backward by respective drawbar/rocker link arrangements (independent of the crank diameter). The fore and aft movement may be varied through a range between zero and several times the crank diameter, ether as a matter of design choice or via an adjustment feature incorporated into the machine. Additional features and/or advantages of the present invention may become apparent from the more detailed description that follows.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENT

Figure 1:
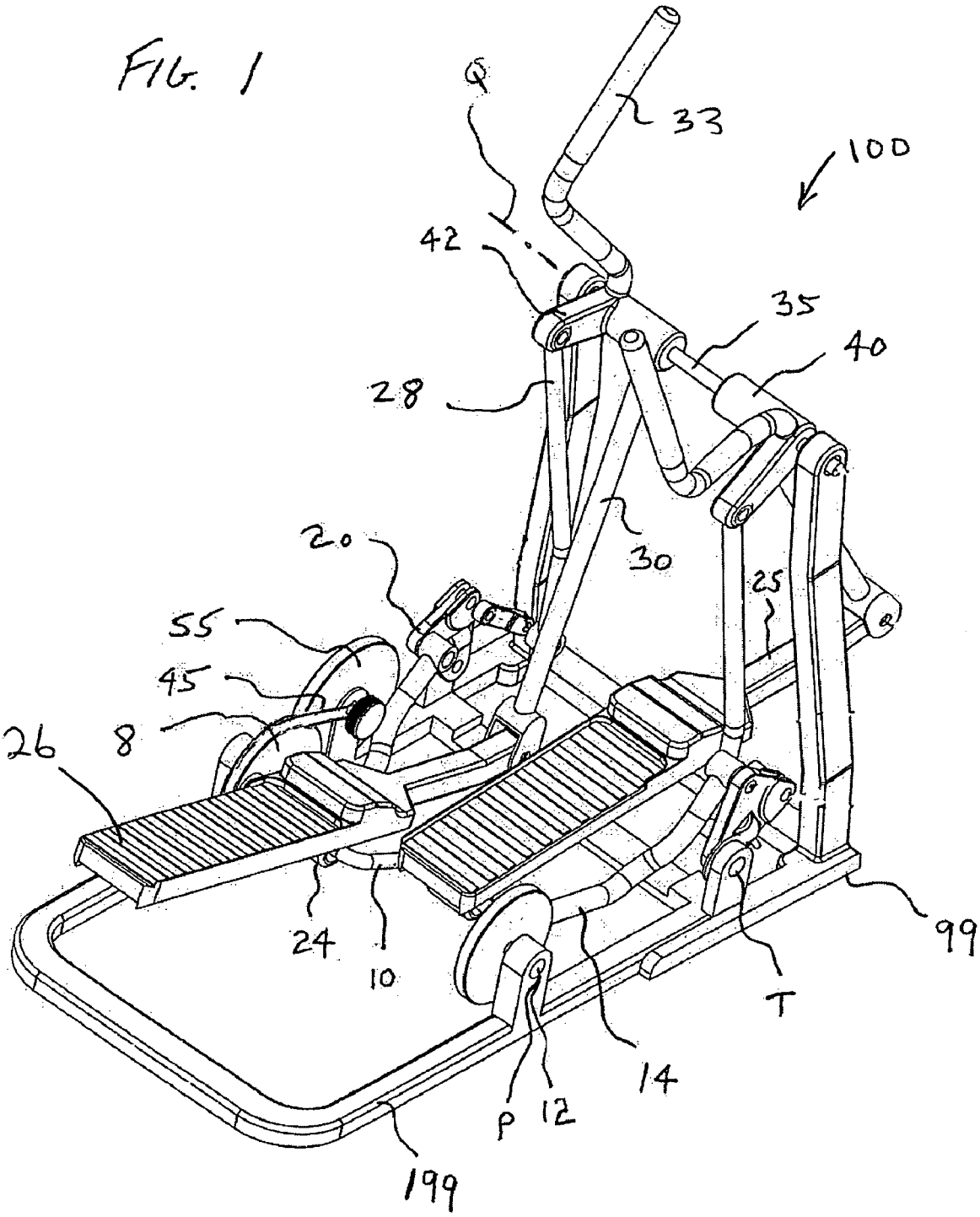
FIG. 1 is a perspective view of an exercise apparatus constructed according to the principles of the present invention.
Figure 2:
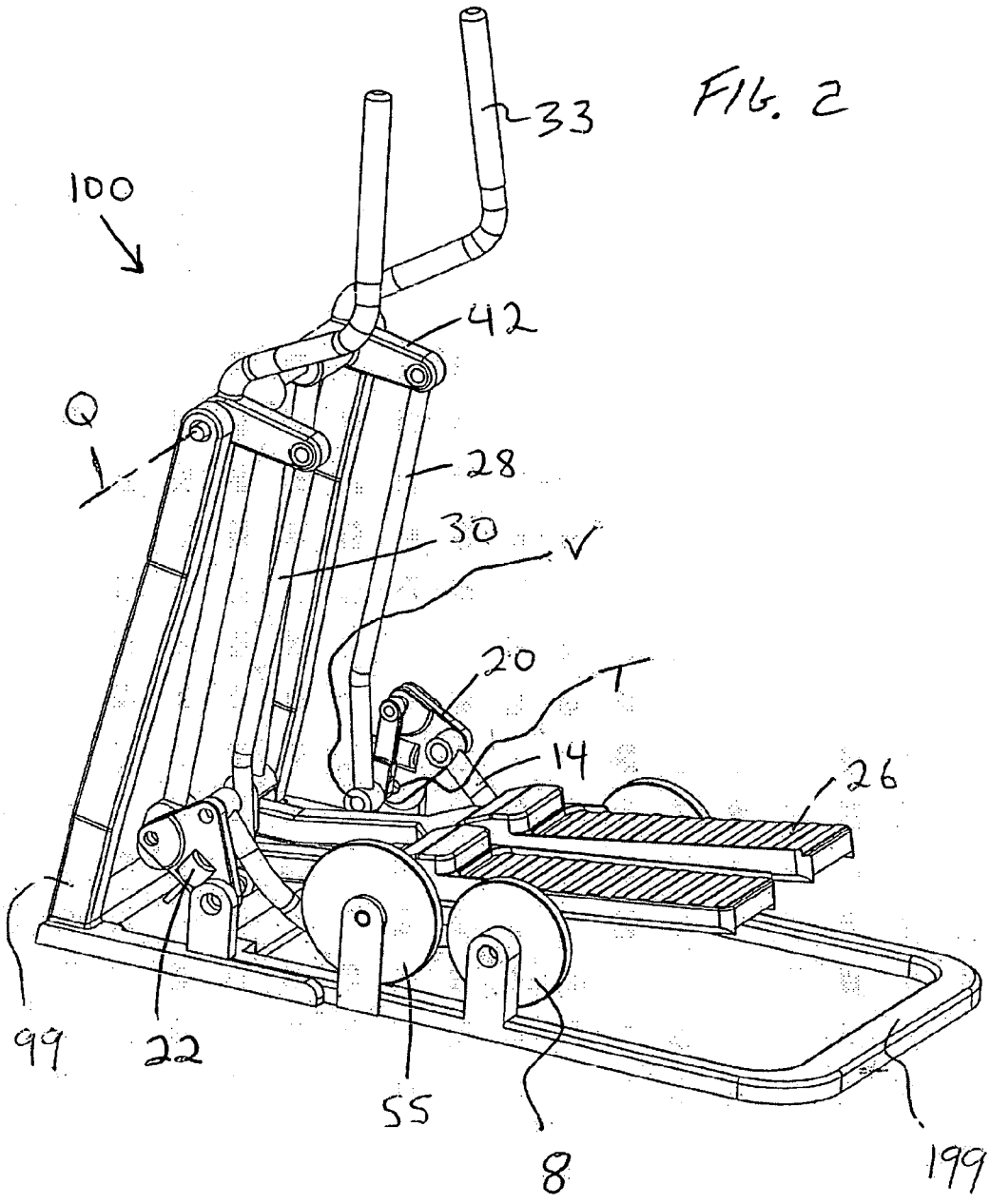
FIG. 2 is a different perspective view of the exercise apparatus of FIG. 1.

The present invention provides elliptical motion exercise machines which link rotation of left and right cranks to generally elliptical motion of respective left and right foot supports. The term "elliptical motion" is intended in a broad sense to describe a closed path of motion having a relatively longer major axis and a relatively shorter minor axis. In general, the present invention may be said to use displacement of the cranks to move the foot supports in a direction coincidental with one axis of the elliptical path, and displacement of crank driven members to move the foot supports in a direction coincidental with the other axis. A general characteristic of the present invention is that the crank diameter determines the length of the one axis, but does not determine the length of the other axis. As a result of this feature, a person's feet may pass through a space between the cranks while nonetheless traveling through a generally elliptical path having a desirable aspect ratio, and the machines that embody this technology may be made relatively more compact, as well.

The embodiments shown and/or described herein are generally symmetrical about a vertical plane extending lengthwise through a floor-engaging base (perpendicular to the transverse ends thereof), the noteworthy exceptions being the provision of a resistance mechanism on only one side of the machine, and the relative orientation of certain parts of the linkage assembly on opposite sides of the plane of symmetry. In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

With the foregoing in mind, the present invention will now be descried with reference to a preferred embodiment exercise apparatus designated as 100 in FIGS. 1-4. The machine 100 includes a frame that is designed to rest upon a floor surface. The frame includes a forward section 99, and a rearward section 199. The rearward section 199 is pivotally connected to the forward section 99 at pivot axis T. The forward section 99 includes a floor engaging base and a forward stanchion that extends upward from a forward end of the base. A display and/or interface device (not shown) may be mounted on the forward stanchion (on the exposed portion of bar 35, for example) to perform various functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the path of the exercise motion, and/or (f) immediately stop the exercise motion.

Left and right cranks 8 are rotatably mounted on respective sides of the rearward frame section 199 at respective journals 12. An intermediate Z-shaped bar or crank connector 10 is interconnected between the cranks 8, and constrains the crank 8 to rotate together as a unit about a common crank axis designated as P. Left and right rollers 24 are rotatably mounted on respective cranks 8 for orbital movement about the crank axis P and rotation relative to respective cranks 8. Both cranks 8 are shown in the form of discs, but crank arms may be used in the alternative. As shown on the depicted machine 100, an advantage of using a crank disc is that it may be more readily connected to any of various known inertia altering devices, including, for example, a motor, a "stepped up" flywheel, an adjustable braking mechanism, or various combinations thereof. For example, the machine 100 is shown with a stepped-up flywheel 55 connected to the left side crank 8 via a belt 45.

Left and right pivot members are pivotally mounted on respective sides of the frame at pivot axis T. Each pivot member includes a triangular plate or first member 20 having a respective pivot connection point at each of its three corners. One of the pivot connection points axially aligns with the pivot axis T. Left and right drawbar links 14 are pivotally interconnected between respective cranks 8 and respective pivot members (at corresponding second pivot connection points on the triangular plates 20). The drawbar links 14 link rotation of respective cranks 8 to pivoting of respective pivot members.

Each pivot member also includes an extension or second member 5 that is pivotally connected to the triangular plate 20 (at the remaining one of the pivot connection points on a respective triangular plate 20). Each pivot member also includes an adjustable length or third member 22, which may be a linear actuator or a manually lead screw, for example. Each adjustable length member 22 is operatively interconnected between a respective triangular plate 20 and a respective extension 5 for purposes of selectively reorienting the extension 5 relative to the pivot axis T, as further explained below.

Left and right rocker links are pivotally mounted on respective sides of the forward stanchion for pivoting about a common pivot axis Q. Each rocker link includes a respective first segment 30 that extends generally downward from the support bar 35 on the forward stanchion; a respective second segment 42 that extends generally rearward from the bar 35; and a respective third segment 33 that extends generally upward from the bar 35. Each third segment 33 is sized and configured for grasping and may be described as a handlebar. Each second segment 42 cooperates with a respective first segment 30 to define an inverted, generally L-shaped configuration.

Left and right connector links 28 are pivotally interconnected between respective second segments 42 and respective extensions 5, thereby linking rotation of respective cranks 8 to pivoting of respective rocker links (via pivoting of respective pivot members). Left and right foot supports 25 have forward ends that are pivotally connected to lower portions of respective first segments 30, and relatively rearward portions hat are supported on respective rollers 24. The resulting linkage arrangement constrains at least part of each foot support 25, including a respective foot pad 26, to move through a generally elliptical path as the cranks 8 rotate.

The foot platforms 26 move through generally elliptical paths that are disposed between the left and right cranks 8. Generally speaking, the vertical displacement of the foot platforms 26 is a function of the crank swing or diameter defined by rotation of the cranks 8. On the other hand, the horizontal displacement of the foot platforms 26 is not similarly limited. In this regard, the extensions 5 may be adjusted relative to respective triangular plates 20 to provide horizontal displacement ranging from essentially zero to several (at least three) times the crank diameter defined by the cranks 8. As the extensions 5 are pivoted closer to alignment with the pivot axis T, the horizontal displacement decreases, and alternatively, as the extensions 5 are pivoted farther from alignment with the pivot axis T, the horizontal displacement increases.

Figure 3:
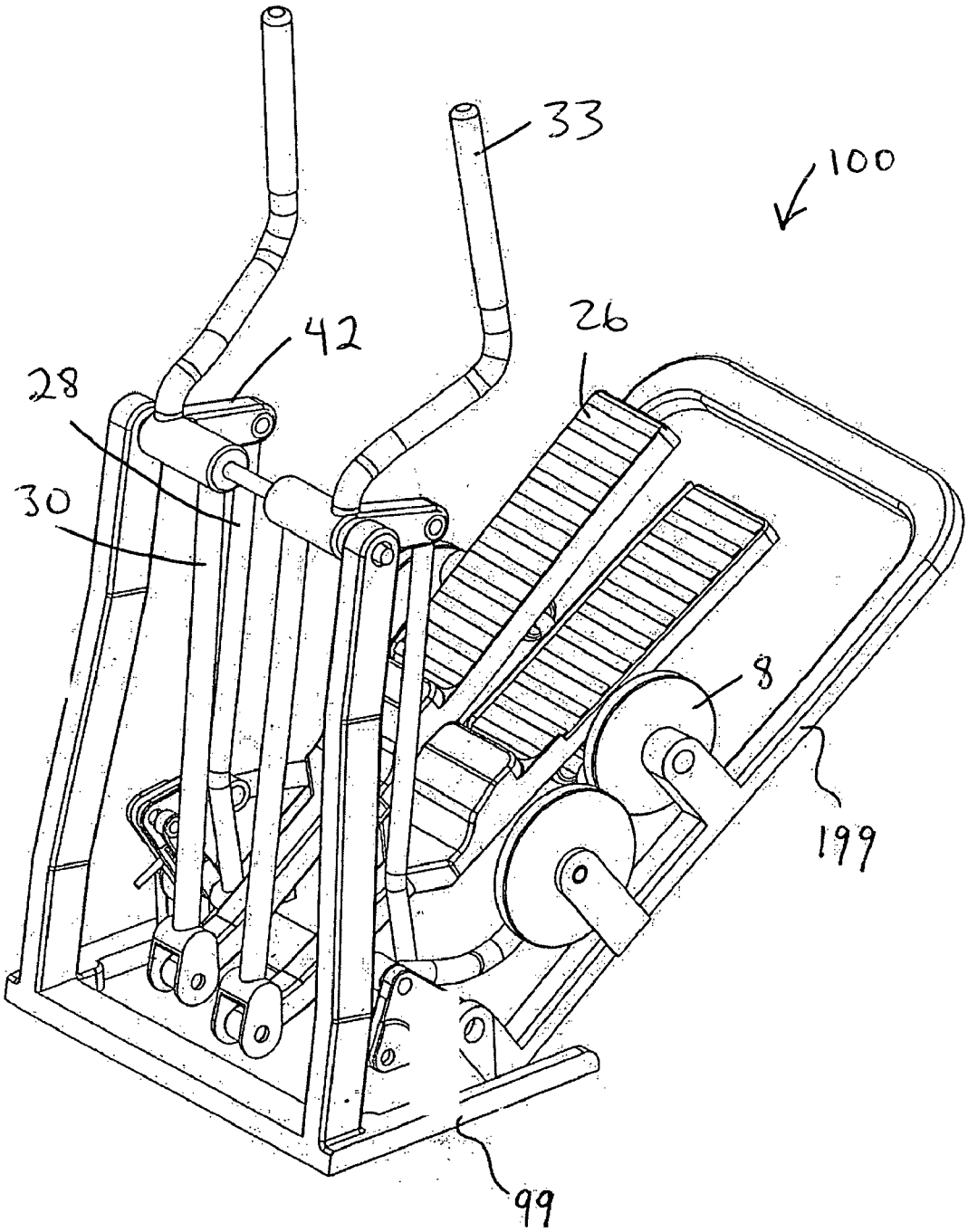
FIG. 3 is another perspective view of the exercise apparatus of FIG. 1, showing a rearward section of the apparatus partially pivoted toward a folded position relative to a forward motion of the apparatus.
Figure 4:
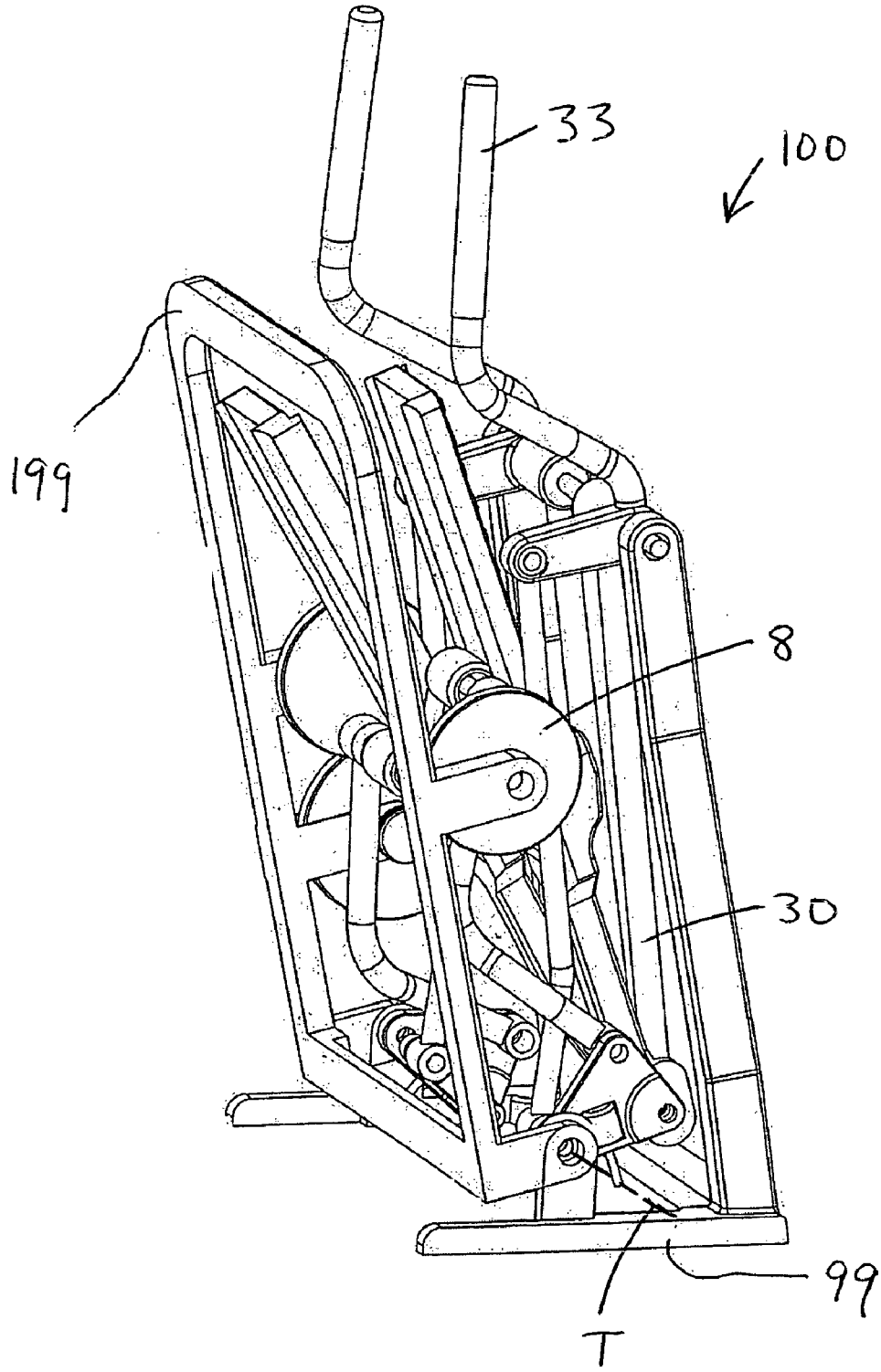
FIG. 4 is yet another perspective view of the exercise apparatus of FIG. 1, showing the rearward section pivoted entirely into a folded position relative to the forward section.

FIGS. 3 and 4 show how the machine 100 may be folded into a more compact configuration, with the rearward frame section 199 pivoted into a generally parallel orientation relative to the forward stanchion on the forward frame section 99. The extensions 5 are preferably moved into alignment with the axis T prior to folding the machine 100 into the configuration shown in FIG. 4. In a manner known in the art, a bolt may be inserted through aligned holes in the two frame sections 99 and 199 to secure the frame in the configuration shown in FIGS. 1-2 and/or the configuration shown in FIG. 4. Also, a spring assist mechanism may be interconnected between the two frame sections 99 and 199 to facilitate folding and unfolding of the rearward section 199 relative to the forward section 99.

The present invention has been described with reference to a preferred embodiment 100 with the understanding that persons skilled in the art will recognize additional embodiments and/or applications. With the foregoing in mind, the scope of the present invention is to be limited only to the extent of the claims which follow.

What is claimed is:

1. An exercise apparatus, comprising:

a frame configured to rest on a floor surface;

a left crank rotatably mounted on a left side of the frame;

a right crank rotatably mounted on an opposite, right side of the frame;

a rigid bar rigidly interconnected between the right crank and the left crank, wherein the rigid bar constrains the left crank and the right crank to remain diametrically opposed to one another and to revolve together about a common crank axis;

a left roller rotatably mounted on the left crank for rotation relative to the left crank and revolution about the crank axis together with the left crank;

a right roller rotatably mounted on the right crank for rotation relative to the right crank and revolution about the crank axis together with the right crank;

a triangular left pivot plate having a first corner pivotally mounted on the left side of the frame;

a triangular right pivot plate having a first corner pivotally mounted on the right side of the frame;

a left rocker link pivotally mounted on the left side of the frame;

a right rocker link pivotally mounted on the right side of the frame;

a left foot support having a first portion supported on the left roller and a second portion pivotally connected to the left rocker link;

a right foot support having a first portion supported on the right roller and a second portion pivotally connected to the right rocker link;

a left drawbar link pivotally interconnected between the left crank and a second corner of the left pivot plate;

a right drawbar link pivotally interconnected between the right crank and a second corner of the right pivot plate;

a left connector link pivotally interconnected between the left rocker link and a third corner of the left pivot plate, thereby constraining at least a portion of the left foot support to move through a generally elliptical path of motion; and a right connector link pivotally interconnected between the right rocker link and a third corner of the right pivot plate, thereby constraining at least a portion of the right foot support to move through a generally elliptical path of motion.

2. The exercise apparatus of claim 1, further comprising a left handle and a right handle, wherein each said handle is disposed on an upper distal end of a respective said rocker link.

3. The exercise apparatus of claim 1, wherein each said rocker link includes a first segment and a second segment that cooperate to define an inverted L-shaped configuration.

4. The exercise apparatus of claim 3, wherein each said foot support is connected to a lower end of a respective said first segment, and each said connector link is connected to a rearward end of a respective said second segment.

5. The exercise apparatus of claim 1, wherein each said pivot member includes a first member that is pivotally mounted on the frame, a second member that is pivotally mounted on the first member, and a third member that is adjustable in length and interconnected between a respective said first member and a respective said second member.

6. The exercise apparatus of claim 5, wherein each said third member is a linear actuator.

7. The exercise apparatus of claim 5, wherein each said connector link is connected to a respective said second member.

8. The exercise apparatus of claim 7, wherein each said first member cooperates with the frame to define a first pivot axis, and each said second member cooperates with a respective said connector link to define a respective second pivot axis, and each said third member is adjustable to make each said second pivot axis co-linear with the first pivot axis.

9. The exercise apparatus of claim 5, wherein each said first member is a triangular plate with a respective pivot connection point defined at each corner thereof.

10. The exercise apparatus of claim 1, wherein, each said crank is rotatably mounted on a rearward section of the frame, and each said rocker link is pivotally mounted on a forward section of the frame, and the rearward section is pivotally connected to the forward section.

11. The exercise apparatus of claim 10, wherein each said pivot member cooperates with the frame to define a pivot axis, and the rearward section pivots about the pivot axis relative to the forward section.

* * * * *